US007854709B2

(12) United States Patent
Neff

(10) Patent No.: US 7,854,709 B2
(45) Date of Patent: Dec. 21, 2010

(54) MUSCLE STIMULATION AND MASSAGE APPARATUS

(76) Inventor: Josef Neff, Alpsteinweg 10, CH-9500 Wil (CH)

( * ) Notice: Subject to any disclaimer, the term of this patent is extended or adjusted under 35 U.S.C. 154(b) by 896 days.

(21) Appl. No.: 10/596,405

(22) PCT Filed: Dec. 10, 2004

(86) PCT No.: PCT/CH2004/000731

§ 371 (c)(1),
(2), (4) Date: May 8, 2007

(87) PCT Pub. No.: WO2005/055915

PCT Pub. Date: Jun. 23, 2005

(65) Prior Publication Data

US 2007/0208283 A1 Sep. 6, 2007

(30) Foreign Application Priority Data

Dec. 12, 2003 (EP) ..... 03405892

(51) Int. Cl.
*A61H 1/00* (2006.01)
*A61H 23/02* (2006.01)

(52) U.S. Cl. ..... 601/29; 601/30; 601/51; 601/56; 601/59; 601/98; 601/104

(58) Field of Classification Search ..... 601/27–30, 601/46, 51, 56, 59, 60, 97, 98, 100, 101, 601/103, 104
See application file for complete search history.

(56) References Cited

U.S. PATENT DOCUMENTS

| | | | | |
|---|---|---|---|---|
| 3,030,949 | A * | 4/1962 | Gassaway | 601/98 |
| 3,529,311 | A * | 9/1970 | Crawford | 5/109 |
| 5,018,511 | A * | 5/1991 | Yokoi | 601/84 |
| 6,013,042 | A * | 1/2000 | Sakai | 601/134 |
| 6,290,660 | B1 * | 9/2001 | Epps et al. | 601/41 |
| 6,932,778 | B2 * | 8/2005 | Hirt | 601/35 |

FOREIGN PATENT DOCUMENTS

| | | |
|---|---|---|
| DE | 195 17 866 C1 | 6/1996 |
| DE | 201 16 277 U1 | 1/2002 |
| DE | 102 01 255 A1 | 7/2003 |
| FR | 1457046 A1 | 9/1966 |
| NL | 1018340 | 3/2003 |

* cited by examiner

*Primary Examiner*—Danton DeMille
(74) *Attorney, Agent, or Firm*—Janet Sleath; Speckman Law Group PLLC

(57) ABSTRACT

A muscle stimulation and massage apparatus is provided that includes (a) a foot plate which is provided with rollers or skids, (b) a column arranged perpendicularly on the foot plate, and (c) a vibration unit that is arranged on a lift, wherein the lift may travel on guide rails of the column and is fastened in a lockable manner at different heights, with the vibration unit being located on a side outside the region of the column. In one embodiment, the lift may continuously travel up and down over a predetermined height range for a period of time in a programmed manner.

20 Claims, 4 Drawing Sheets

MUSCLE STIMULATION AND MASSAGE APPARATUS

FIELD OF THE INVENTION

The invention relates to a muscle stimulation and massage apparatus.

BACKGROUND OF THE INVENTION

Apparatus are employed in the field of fitness and therapy that produce vibrations which are transmitted via a contact surface onto the person to be treated or trained. The vibrations may have a positive effect on muscles as well as on bones. An effective stimulation of muscle fibers is possible if the muscle fibers are brought in an oscillating manner from a basic tonus, or muscle tone, into a threshold region with an increased tension. The basic tonus depends on the constitutional tonus and on the pre-tension selected during the treatment. The pre-tension is due to the weight or the selected posture, and also to a deliberate flexing of the muscles. The stimulation caused by the vibrations becomes optimal when it is capable of being transmitted onto the body, or onto a muscle to be treated, with a large movement component in the direction of the muscle fibers to be stimulated. In order to amplify the effect of the treatment, the treated muscles may be massaged during the treatment. For this reason, the muscle stimulation apparatus should be constructed such that the treated muscles are comfortably accessible for a massage. With the treatment of bones, the vibration should be transmitted onto the body in the direction of the bone with a movement component that is large as possible.

With a person to be treated, the vibration should be able to be transmitted at least via a contact surface for the feet and as the case may, be for the backside as well as in particular also via grips for the hands. Accordingly, the person to be treated is situated in a standing, sitting or hanging posture.

The vibration should have frequencies or periods in the region of the excitation and decay times of muscle fibers. The usual applications envisage excitation frequencies in the region of 1 to 60 Hz. Apparatus with a settable frequency permit an adaptation of the frequency to the purpose of treatment, and thus an optimal treatment. The amplitude of the vibration for example lies in the range of 1-10 mm, preferably however of 4-6 mm. The weight which may be set into vibration, lies in the range of 10-150 kg.

EP-0,929,284 describes a muscle stimulation apparatus with two foot plates which travel apart and which are pivotally mounted on a horizontally running middle axis and may be set into pivot movements via in each case one shaft each by way of an eccentric transmission. In order to avoid an undesired imbalance of the shafts, the shafts are balanced by the attachment of balancing weights. The apparatus however produces undesirably loud noises, which as air sound are transmitted directly and as body sound are emitted via the ground. The oscillations that cause the noises arise due to the inertia forces of the foot plates when pivoted up and down. These forces, which are opposite to the acceleration forces, are transmitted onto the apparatus and from this onto the ground. A further disadvantage of this apparatus lies in the fact that the foot plates, on account of their pivot movements, have the tendency to likewise displace the legs of the person standing on the plates, into a pivot movement. This pivot component of excitation must be accommodated proportionally by the ankles, the knees and the hip joints, which can lead to undesirable effects on the joints. Apparatus according to EP-0,929,284 are limited to the stimulation of the muscles in the longitudinal direction of the body and in particular to the leg muscular system. Vibrations which are to act on the muscles of the torso and the arms would have to act on the legs with undesirably large amplitudes, and be transmitted by these onto the torso on account of the damping in the ankles, knees and hip joints. This indirect excitation may lead to problems in the joints, and does not ensure a defined excitation with the torso muscles.

U.S. Pat. No. 5,500,002 describes a solution which is similar to the embodiments of EP-0,1929,284, with two foot plates which may be set into a pivot movement, wherein the foot plates may be excited with different and settable amplitudes. This solution likewise has the disadvantages described above.

U.S. Pat. No. 5,273,028 describes a solution with a parallel vibrating plate, wherein the vibration is not produced by a rotating shaft, but via electromagnetic actuators. The application is limited to the stimulation via the feet and legs. Furthermore, noise arises from the electromagnetic actuators.

A further device with electromagnetic actuators is known from U.S. Pat. No. 5,484,388. This device is employed in the field of bone treatment, wherein a bone which is preloaded with a static force is impinged with force impacts in the direction of the static force. The embodiment is constructed in a complicated manner, is cumbersome in its application, and is not directed to vibrating muscle stimulation.

U.S. Pat. No. 2,427,053 describes a device with vibrating surfaces in the region of a seat or back rest, wherein the movement is effected tangentially to the surface of the contact surfaces. Because tangential movements are already greatly dampened in the region of the skin- and fat layer close to the surface, the desired muscle stimulation cannot be achieved in a sufficient scope.

An apparatus is commercially available whose contact surface executes a forwards and backwards movement with a tilt component. Apart from the unacceptable production of sound, the tilt component of the vibration is also an undesirable disadvantage of this solution. The apparatus comprises a rod arrangement which may be fastened at the contact surface and which extends up to beyond the body surface of a person to be treated. Grips are arranged at the upper end of the rod arrangement, so that as the person grasps the grips with tensed muscles for the stimulation of the arm muscles, the amplitude of the tilt component of the vibration is increased linearly by the rod arrangement. A movement at the grips arises on account of this, which is not suitable for the desired treatment.

SUMMARY OF THE INVENTION

It is the object of the invention to provide a muscle stimulation and massage apparatus which overcomes the above-mentioned disadvantages and permits further fields of application.

This object is achieved by an apparatus having (a) a foot plate which is provided with rollers or skids, (b) a column arranged perpendicularly on the foot plate, and (c) a vibration unit that is arranged on a lift, wherein the lift may travel on guide rails of the column and is fastened in a lockable manner at different heights, with the vibration unit being located on a side outside the region of the column. In one embodiment, the lift may continuously travel up and down over a predetermined height range for a period of time in a programmed manner.

In one aspect, the vibration unit comprises a housing with an intermediate base and a vibration plate, wherein the vibration plate is connected to the intermediate base by way of at least one spring unit. A drive shaft is present in the housing, which comprises at least one eccentric that is pivotally connected to the vibration plate via a coupling rod. The drive shaft may lead laterally out of the housing and be provided with receivers at the lateral ends, for receiving additional elements for vibration therapy, such as eccentric disks, pulleys or hand loops. The vibration unit may be provided with a programmable control, so that the time and/or vibration frequency may be changed. In one embodiment, the housing of the vibration unit is pivotable about a horizontal pivot axis.

In certain embodiments, the spring unit is a two-dimensionally designed leaf spring which is fastened on the intermediate base and on the vibration plate, so that it guarantees the lateral guiding of the vibration plate and prevents a lateral backing-away of the vibration plate with respect to the housing. The leaf spring may comprise an upper spring plate and a lower spring plate, wherein the lower spring plate is provided with an opening through which the coupling rod passes. The leaf spring may consist of a number of leaf spring elements. In alternative embodiments, the spring unit comprises torsion rods.

The vibration plate may be designed as a vibration cushion and reach at least partly into the housing. A vibration rod may be connected on the vibration cushion, which moves with the vibration cushion and may be provided with additional elements.

In certain embodiments, the foot plate, on the side of the column on which the vibration unit is located, has a fork-like design and comprises two fork ends which are distanced to one another, with the distance between the two fork ends corresponding to at least the width of the vibration unit, so that the vibration unit with the lift may travel down between the fork ends.

One additional advantage of the invention is the fact that the muscle stimulation and massage apparatus according to the invention may also be equipped as a base apparatus for further applications by way of additional elements.

BRIEF DESCRIPTION OF THE DRAWINGS

The invention is hereinafter described in combination with the drawings, wherein.

DETAILED DESCRIPTION

Figure 1A:
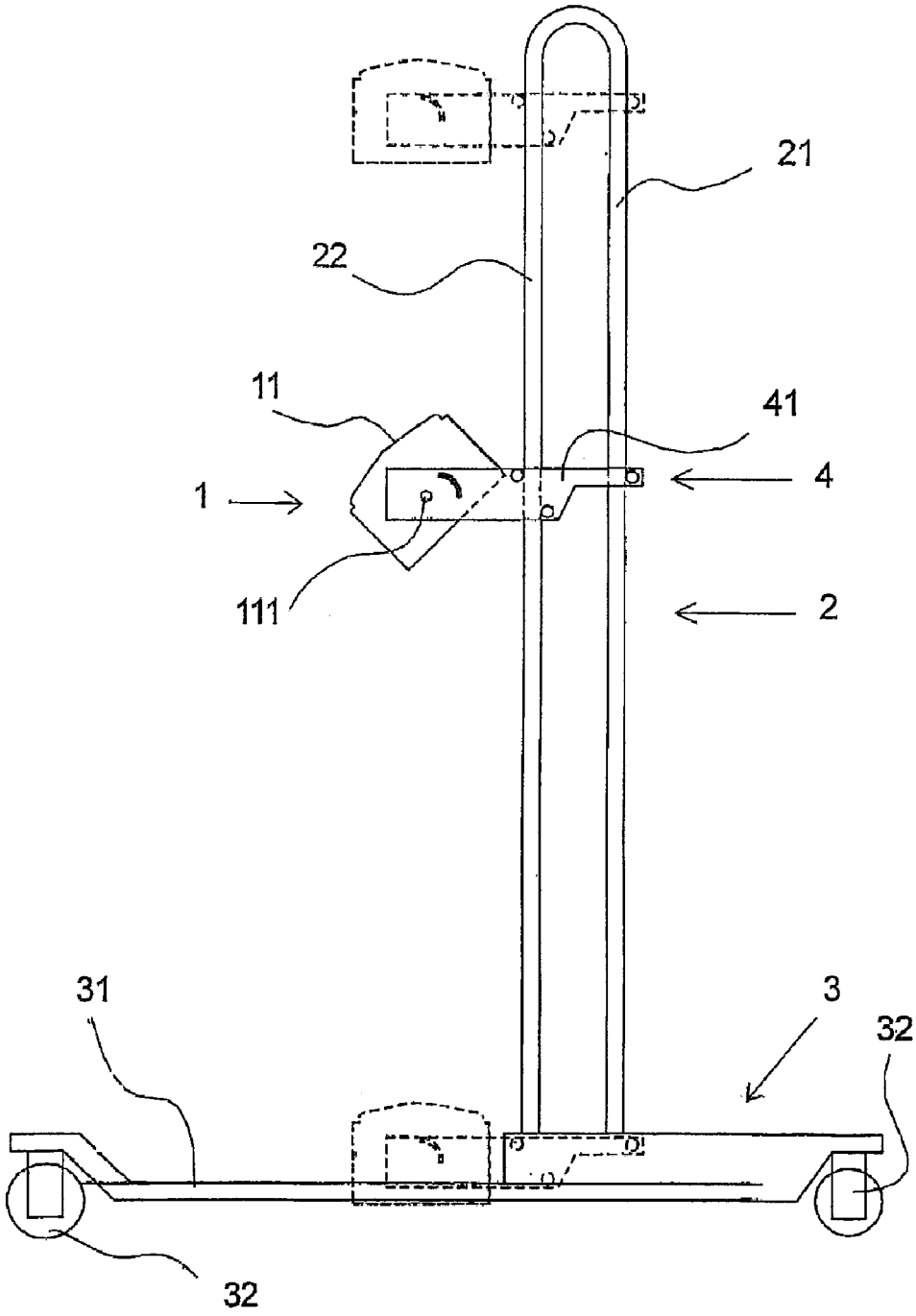
FIG. 1*a* shows a muscle stimulation and massage apparatus according to the invention, in a lateral view.
Figure 1B:
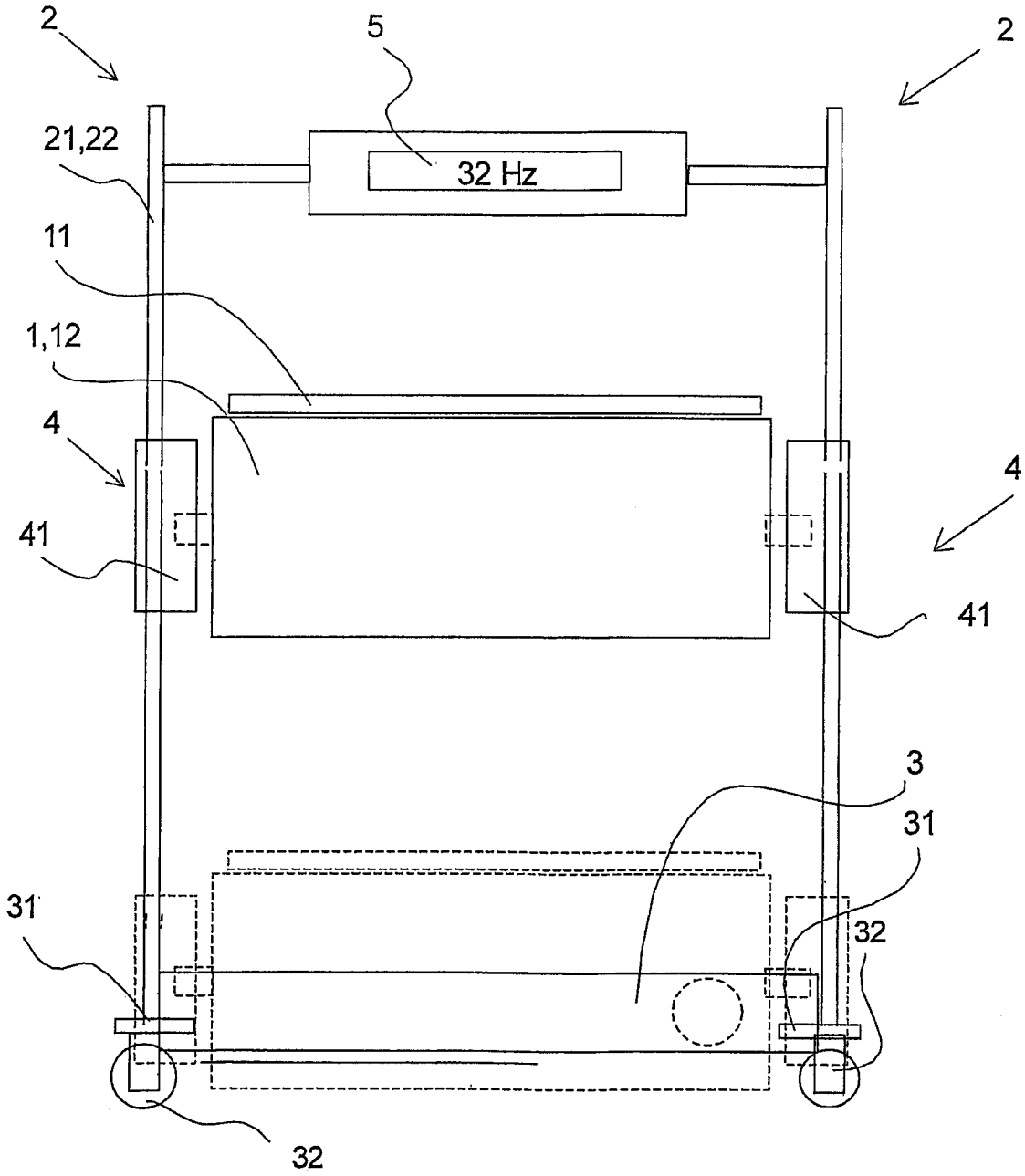
FIG. 1*b* shows a muscle stimulation and massage apparatus according to the invention, from the front.

A muscle stimulation and massage apparatus according to the invention, as is represented in the FIGS. 1*a* and 1*b*, comprises a foot plate 3, a column 2 and a vibration unit 1. The foot plate 3 circumscribes a rectangular surface. Rollers and/or runners 32 are attached in the regions of the corners of the rectangular surface. The column 2 stands on the foot plate 3. The column 2 comprises two guide rail towers which are laterally distanced to one another, each with at least one guide rail 21, 22. A lift 4 may travel up and down on the guide rails 21, 22, so that it may be brought into various heights with respect to the foot plate 3 and locked in position. The lift has the shape of a U-shaped support with two lateral arms. The vibration unit 1 is fastened between the open ends, outside the region of the guide rails 21, 22. An evaluation and display unit 5 may be present at the upper end of the column 2. The oscillation number, the treatment duration, etc. may be read off from this. A pulse control may further be installed, which functions according to the known principle with a wireless pulse meter.

The foot plate 3 has the shape of a fork. Two fork ends 31 are arranged such that the free space therebetween corresponds to at least the width of the vibration unit 1. The vibration unit 1 may travel down on the lift until it is located between the fork ends 31.

The lift 4 is displaceably fastened on the guide rails by way of rollers or sliding bearings. The rollers or sliding bearings ensure that the lift may be positioned as desired, and may also be firmly held there. Lift 4 is provided with a lift drive 41. The lift drive 41 is advantageously arranged within the foot plate 3, so that the center of gravity of the whole muscle stimulation and massage apparatus remains low. Lift drive 41 drives the lift by way of a pull cable, toothed belt or spindle as known in the art. It is also possible to arrange the lift drive 41 in the lift itself. At least one of the guide rails may be toothed, and the drive 41 provided with a toothed wheel which engages into the toothing.

The vibration unit 1 is fastened on the stand of the lift 4 in a firm manner, or pivotally about a horizontal pivot axis. In the case of the pivotable fastening, the lift may be fixed in all pivot conditions. For this, the lateral frame parts of the lift 4 may, for example, be provided with circular grooves or cut-outs in which locking means run in a displaceable manner. The vibration unit is locked in the desired pivot position by way of quick levers, winged nuts or the like.

Figure 2:
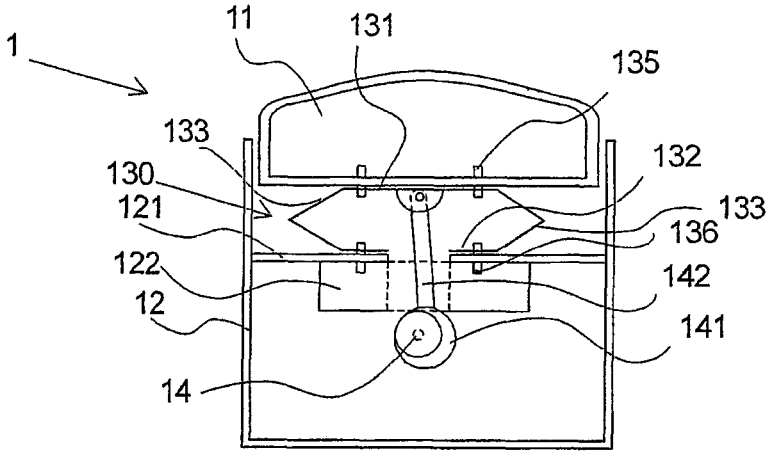
FIG. 2 shows the vibration unit in a cross section.
Figure 3:
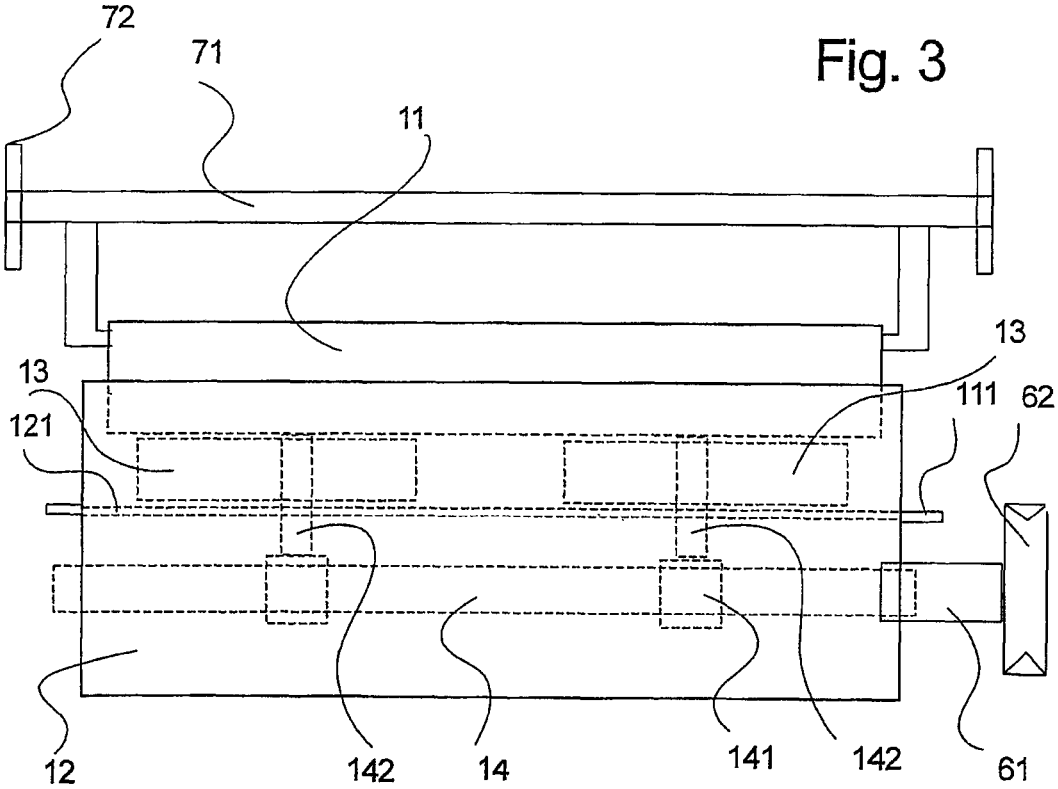
FIG. 3 shows the vibration unit in a view from the front with attached elements.

A cross section through the vibration unit is shown in FIG. 2. The vibration unit 1 has roughly the shape of a parallelepiped. A housing 12 comprises a base, two parallel side walls and two parallel end walls. One side of the housing 12, in FIG. 2 the upper one, is open. A vibration plate or a vibration cushion 11 with a rectangular base surface and an upwardly curved surface partly projects into the inner space of the housing 12. The distance between the housing inner wall and the vibration cushion 11 is minimal. It is thus not possible to inadvertently insert a finger or object between the housing and vibration cushion, and for the finger or object to become jammed. This ensures the safety of the person who is receiving the therapy and the person administering it. Injuries are thus avoided.

The vibration drive is arranged in the housing 12 of the vibration unit 1. Here a drive shaft 14 is present parallel to the length of the housing 12. Drive shaft 14 comprises at least one eccentric 141. A coupling rod 142 is articulated on the eccentric 141 and connects the eccentric 141 to the vibration plate or to the vibration cushion 11 where it ends on a pivot joint 111. The rotational movement of the drive shaft is thus converted into a linear movement of the vibration cushion 11 and produces the up- and down vibration of the vibration cushion 11. The travel of the vibration cushion is selected between about 1 and 6 mm. Another eccentric may be designed according to the known design, such that the travel may be varied in a preset manner. The travel of the vibration cushion may then be varied between about 1 and 6 mm. One design with a variable cam may be constructed such that the travel may even be varied during the operation. Several eccentrics 141 each with a coupling rod 142 may be present, which permits a smaller dimensioning of the individual elements. A vibration cushion, a vibration rod, a vibration foot rest or the like may be attached to the design with a vibration plate.

The housing 12 comprises an intermediate base 121. It is provided with recesses through which the coupling rods 142 run. At least one spring unit 13 is fastened on the intermediate base 121. The spring unit 13 advantageously consists of a leaf spring 130 which is of one piece or is divided into several two-dimensional segments. In the embodiment shown in FIG. 2, it has a lower spring plate 132 and an upper spring plate 131. The lower spring plate 132 lies on the intermediate base 121 and is fastened there with a spring mounting 136. Here lower spring plate 132 likewise comprises a recess for the movement of the coupling rod 142. The upper spring plate 131 is fastened on the lower side of the vibration cushion 11 with a spring fastening 135, screws, rivets or the like. The spring unit 130 between the upper and lower spring plates 131, 132 comprises at least in each case one spring angle 133 as a resilient connection of the upper and the lower spring plates 131, 132. The spring unit 130 seen from above, comprises a rectangular to square outline. It corresponds in area to a maximum of approximately the base area of the vibration cushion 11. Of course the spring unit 130 may be divided up into several individual leaf spring elements. This geometric design ensures the exact guiding of the vibration cushion 11 during operation. The leaf spring 130 not only assumes the guiding of the vibration cushion, but also the damping of the oscillations and accelerations in the upper and lower region of the movement of the vibration cushion and thus also significantly reduces the noise caused by the vibrations and the mechanics. A vibration compensation shaft of a known design may be present in the vibration unit 12 for additional comfort.

Figure 4:
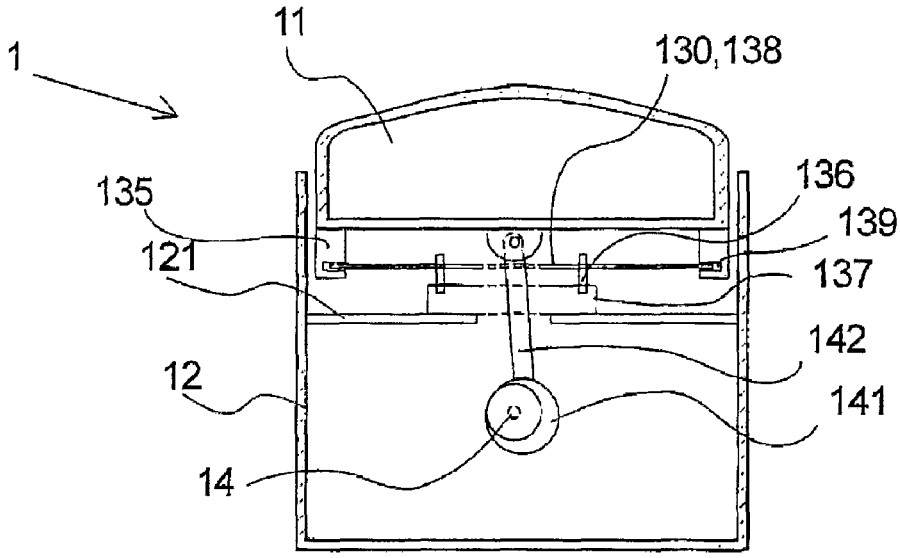
FIG. 4 shows one variant of the leaf spring of FIG. 2.

Another design for the leaf spring is shown from FIG. 4. The leaf spring here consists of a single spring plate 138. It may be flat, plane or curved and possibly biased. It may be constructed of one piece or of several layers and may consist of different materials. Since the constructional height is smaller, it is advantageously fastened on a bearing block 137 on the intermediate base 121 with a spring mounting 136. Laterally, upper spring fastenings 135 and 135' are present on the lower side of the vibration plate 11, which are each provided with a receiver groove 139. The single spring plate is mounted with its lateral edges on the periphery in these receiver grooves 139. Some play is present between the spring plate and the receiver groove 139 for the movement of the single spring plate 138. The single spring plate 138, as with the spring unit 13 described above, may extend from one piece over approximately the whole surface of the vibration plate 11. It may also be subdivided into several individual segments arranged next to one another, just as with the spring unit 13. As an extreme case, it may even consist of a plurality of thin spring rods.

A design of at least two torsion springs may be applied instead of a leaf spring 130 or a single spring plate 138. The torsion springs are each fixed between the intermediate base 121 and the lower side of the vibration plate.

The vibration cushion has a hard core. It may consist of a metal-, wood- or plastic body. The vibration cover is provided at the tip and laterally with a cushioning of leather or another suitable material of the known type.

The drive shaft 14 may extend laterally up to the end sides of the housing 12 or even beyond. Additional apparatus may then be connected at these ends, which likewise may be set into rotation by the drive shaft. The additional apparatus may be screwed on or, provided with a bayonet-like or similar quick-closure, may be stuck on.

For an example of such an additional apparatus, a pulley 62 may be placed on the drive shaft 14 at both sides (see FIG. 1*b*). One may also use an eccentric disk in each case, on which further modules, such as hand loops, freely rotating pulleys and the like, may be placed.

Since the vibration plate or the vibration cushion 11 are mostly moved with an amplitude of about 5 mm, one may achieve a different deflection or amplitude for certain therapies by way of the design of the eccentric disks. It is possible to select this in a large range. The eccentric disks may be fastened in the same directions or in a rotationally offset manner. For example with eccentrics fastened rotationally offset by 180°, one may fit a belt. With this, one may carry out a vibration massage as is known from well known belt vibrators.

A further additional apparatus (see FIG. 1*b*) forms a vibration rod 71 which is stuck laterally on the vibration cushion 11. The vibration rod is then located at a distance above the rest of the vibration cushion 11. Here too, hand loops or cable rollers (pulleys) 72 may be fixed, thereby enabling the selective vibration stimulation of extremities of the person who is to undergo therapy. The hand loops may also be used by a therapist in order, when massaging a person undergoing therapy, to assist the massage by way of the vibration movement of the apparatus. For this, he places his hand through the hand loop, so that his forearm rests in the hand loop and is moved by this whilst he carries out the massage with the surface of his hand.

Furthermore, for example a pull cable may be applied over the pulley, with a hand loop or a ring for hands, forearms, etc. attached at one end and an exchangeable weight or a settable loading spring attached at the other end. This applies for both the additional apparatus described above.

An additional extension of the field of application of the muscle stimulation apparatus results with the combination of the vibration movement with a movement of the lift 4. For this, the lift is provided with a program control. The lift may thus travel continuously up and down over a certain height range during a certain therapy time, in which the vibration unit 1 is in action. A stimulation of the upper thigh muscle system transversely to the longitudinal muscle fibers is given as an example. For this, the vibration unit is pivoted such that the vibration movement is carried out perpendicularly to the column 2. The lift is programmed such that it simultaneously travels up and down over the region just above the knee up to just above the loin. This movement region must of course be set differently for each person and each muscle region.

For further simplifying and improving the therapy possibilities, the vibration unit is provided with a programmable control. With this, the time duration as well as the vibration frequency may be preset. The vibration frequency may also be changed for a determinable time. Thus one may prevent the muscle system from adjusting to the set frequency and reducing the effect of treatment.

LIST OF REFERENCE NUMERALS

1 vibration unit
2 column
3 foot plate
4 lift
11 vibration plate/cushion
12 housing
13 spring unit
14 drive shaft
21 guide rail
22 guide rail
31 fork plate
32 rollers or skids
41 lift unit
111 pivot joint
121 intermediate base
130 leaf spring
131 upper leaf spring

132 lower leaf spring
133 spring angle
135 upper spring fastening
135' upper spring fastening
136 spring holder
137 bearing block
138 single spring plate
139 receiver groove
141 eccentric
142 coupling rod

The invention claimed is:

1. A muscle stimulation and massage apparatus comprising:
(a) a foot plate;
(b) a column arranged perpendicularly on the foot plate and comprising two guide rails; and
(c) a vibration unit arranged on a lift, the vibration unit comprising:
(i) a housing with an intermediate base;
(ii) a vibration plate connected to the intermediate base by way of at least one spring unit, wherein the spring unit comprises at least one torsion rod; and
(iii) a drive shaft located the housing, the drive shaft comprising at least one eccentric which is pivotally connected to the vibration plate via a coupling rod,
wherein the lift is able to travel on the guide rails and is lockable at different heights, and wherein the vibration unit is located on a side of the column outside the guiderails.

2. A muscle stimulation and massage apparatus according to claim 1, wherein the vibration plate is designed as a vibration cushion and reaches at least partly into the housing.

3. A muscle stimulation and massage apparatus according to claim 1, wherein the housing of the vibration unit on the lift is pivotable about a horizontal pivot axis.

4. A muscle stimulation and massage apparatus according to claim 1, wherein the footplate, on the side of the column on which the vibration unit is located, comprises two fork ends which are distanced to one another, and wherein the distance between the two fork ends corresponds to at least the width of the vibration unit, so that the vibration unit may travel down between the fork ends.

5. A muscle stimulation and massage apparatus according to claim 1, wherein the lift may continuously travel up and down over a predeterminable height range for a duration of time in a programmed manner.

6. A muscle stimulation and massage apparatus according to claim 1, wherein the footplate is provided with rollers.

7. A muscle stimulation and massage apparatus comprising:
(a) a foot plate;
(b) a column arranged perpendicularly on the foot plate and comprising two guide rails; and
(c) a vibration unit arranged on a lift, the vibration unit comprising:
(i) a housing with an intermediate base;
(ii) a vibration plate being connected to the intermediate base by way of at least one spring unit; and
(iii) a drive shaft located in the housing, the drive shaft comprising at least one eccentric which is pivotally connected to the vibration plate via a coupling rod, wherein the drive shaft passes laterally out of the housing and is provided with receivers located outside the housing for receiving at least one additional element for a vibration therapy,
wherein the lift is able to travel on the guide rails and is lockable at different heights, and wherein the vibration unit is located on a side of the column outside the guiderails.

8. A muscle stimulation and massage apparatus according to claim 7, wherein the at least one additional element is selected from the group consisting of: eccentric disks; pulleys; and hand loops.

9. A muscle stimulation and massage apparatus comprising;
(a) a foot plate;
(b) a column arranged perpendicularly on the foot plate and comprising two guide rails; and
(c) a vibration unit arranged on a lift, the vibration unit comprising:
(i) a housing with an intermediate base;
(ii) a vibration plate connected to the intermediate base by way of at least one spring unit;
(iii) a vibration rod is connected to the vibration plate, the vibration rod being moveable with the vibration plate and wherein the vibration rod is provided with at least one additional element;
(iv) a drive shaft located in the housing, the drive shaft comprising at least one eccentric which is pivotally connected to the vibration plate via a coupling rod,
wherein the lift is able to travel on the guide rails and is lockable at different heights, and wherein the vibration unit is located on a side of the column outside the guiderails.

10. A muscle stimulation and massage apparatus according to claim 9, wherein the at least one additional element is selected from the group consisting of: eccentric disks; pulleys; and hand loops.

11. A muscle stimulation and massage apparatus comprising:
(a) a foot plate;
(b) a column arranged perpendicularly on the foot plate and comprising two guide rails; and
(c) a vibration unit arranged on a lift, the vibration unit comprising:
(i) a housing with an intermediate base;
(ii) a vibration plate connected to the intermediate base by way of at least one spring unit comprising a two-dimensionally designed leaf spring which is attached to the intermediate base and the vibration plate, whereby the spring unit guides the vibration plate and prevents a backing-away of the vibration plate with respect to the housing; and
(iii) a drive shaft located in the housing, the drive shaft comprising at least one eccentric which is pivotally connected to the vibration plate via a coupling rod,
wherein the lift is able to travel on the guide rails and is lockable at different heights, and wherein the vibration unit is located on a side of the column outside the guiderails.

12. A muscle stimulation and massage apparatus according to claim 11, wherein the vibration unit is provided with a programmable control, whereby at least one of the time duration and vibration frequency may be changed.

13. A muscle stimulation and massage apparatus according to claim 11, wherein the leaf spring comprises an upper spring plate and a lower spring plate, and wherein the lower spring plate is provided with an opening through which the coupling rod passes.

14. A muscle stimulation and massage apparatus according to claim 11, wherein the leaf spring comprises multiple leaf spring elements.

15. A muscle stimulation and massage apparatus according to claim 11, wherein the vibration plate is designed as a vibration cushion and reaches at least partly into the housing.

16. A muscle stimulation and massage apparatus according to claim 11, wherein the housing of the vibration unit on the lift is pivotable about a horizontal pivot axis.

17. A muscle stimulation and massage apparatus according to claim 11, wherein the foot plate, on the side of the column on which the vibration unit is located, comprises two fork ends which are distanced to one another, and wherein the distance between the two fork ends corresponds to at least the width of the vibration unit, so that the vibration unit may travel down between the fork ends.

18. A muscle stimulation and massage apparatus according to claim 11, wherein the lift may continuously travel up and down over a predeterminable height range for a duration of time in a programmed manner.

19. A muscle stimulation and massage apparatus according to claim 11, wherein the footplate is provided with rollers.

20. A muscle stimulation and massage apparatus according to claim 11, wherein the foot plate is provided with skids.

* * * * *

UNITED STATES PATENT AND TRADEMARK OFFICE

CERTIFICATE OF CORRECTION

PATENT NO. : 7,854,709 B2
APPLICATION NO. : 10/596405
DATED : December 21, 2010
INVENTOR(S) : Josef Neff It is certified that error appears in the above-identified patent and that said Letters Patent is hereby corrected as shown below:

| Col. No. | Line(s) | Edits |
|---|---|---|
| 7 | 23 | Replace "(iii) a drive shaft located the housing" with --(iii) a drive shaft located in the housing-- |

Signed and Sealed this
Fifth Day of April, 2011

David J. Kappos

David J. Kappos
*Director of the United States Patent and Trademark Office*